US009696109B2

(12) United States Patent
Harvey et al.

(10) Patent No.: US 9,696,109 B2
(45) **Date of Patent: *Jul. 4, 2017**

(54) AIRSOFT GUN WITH GUN MOUNTED AIR SUPPLY SYSTEM

(71) Applicants: Daniel D. Harvey, Lake Geneva, WI (US); James Tentes, Salem, WI (US)

(72) Inventors: Daniel D. Harvey, Lake Geneva, WI (US); James Tentes, Salem, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/057,243

(22) Filed: Mar. 1, 2016

(65) Prior Publication Data

US 2016/0245615 A1 Aug. 25, 2016

Related U.S. Application Data

(63) Continuation-in-part of application No. 14/471,499, filed on Aug. 28, 2014, now Pat. No. 9,297,606.

(60) Provisional application No. 61/871,977, filed on Aug. 30, 2013.

(51) Int. Cl.

| | |
|---|---|
| ***F41B 11/62*** | (2013.01) |
| ***F41B 11/72*** | (2013.01) |
| ***F41C 23/22*** | (2006.01) |
| *F41B 11/724* | (2013.01) |

(52) U.S. Cl.

CPC ..... *F41B 11/62* (2013.01); *F41B 11/72* (2013.01); *F41C 23/22* (2013.01); *F41B 11/724* (2013.01)

(58) Field of Classification Search

CPC ..... F41B 11/60; F41B 11/724

See application file for complete search history.

(56) References Cited

U.S. PATENT DOCUMENTS

| | | | | |
|---|---|---|---|---|
| 4,148,245 | A * | 4/1979 | Steffanus | F41A 1/04 89/135 |
| 6,474,325 | B2 * | 11/2002 | Rice | F41A 17/06 124/70 |
| 7,065,914 | B1 * | 6/2006 | Wagner, II | F41C 23/04 124/74 |
| 8,087,406 | B2 | 1/2012 | Axelsson | |
| 8,578,922 | B1 * | 11/2013 | Granger | F41B 11/57 124/71 |
| 8,671,928 | B2 | 3/2014 | Hague et al. | |
| 9,297,606 | B2 * | 3/2016 | Harvey | F41B 11/62 |
| 2002/0046747 | A1 | 4/2002 | Colby | |
| 2012/0192847 | A1 | 8/2012 | Hague et al. | |

* cited by examiner

*Primary Examiner* — Reginald Tillman, Jr.

(74) *Attorney, Agent, or Firm* — Andrus Intellectual Property Law, LLP

(57) ABSTRACT

An gas supply system for use with an airsoft gun to power a pneumatic engine contained within a receiver of the airsoft gun. The gas supply system includes a bottle of pressurized gas that supplies pressurized gas at a first pressure to the receiver. A pressure regulator is located between the supply of pressurized gas and the pneumatic drive engine and operates to reduce the pressure of the gas from the first pressure to a second pressure. The pressure regulator is supported on the airsoft gun and allows the pressure of gas supplied to the pneumatic engine of the airsoft gun to be regulated. The pressure regulator includes an adjustment dial that allows an operator to change the pressure of gas supplied to the airsoft gun. The pressure regulator can be located between the bottle of pressurized gas and the receiver.

18 Claims, 25 Drawing Sheets

AIRSOFT GUN WITH GUN MOUNTED AIR SUPPLY SYSTEM

CROSS-REFERENCE TO RELATED APPLICATION

The present application is a Continuation-In-Part (CIP) of U.S. patent application Ser. No. 14/471,499, filed Aug. 28, 2014, which is based on and claims priority to U.S. Provisional Patent Application Ser. No. 61/871,977, filed Aug. 30, 2013, the disclosures of which are both incorporated herein by reference.

BACKGROUND

The present disclosure relates to a system and method for mounting a gas supply system to an airsoft gun. More specifically, the present disclosure relates to a system for mounting both a gas supply and regulator to the body of an airsoft gun Airsoft refers to a recreational activity in which replica firearms are used to shoot plastic BBs in the place of bullets or live ammunition. Airsoft guns are designed to have the appearance, weight and feel of the actual firearm upon which they are modeled. Airsoft guns shoot plastic BBs having a weight of approximately 0.2 grams.

Airsoft guns are used in recreational games that include a simulated battlefield where participants divide into multiple teams and attempt to achieve goals, such as capturing a flag or eliminating all of the opponents on the opposite team.

Most currently available airsoft guns utilize a combination pneumatic and spring power source to propel plastic BBs from the gun. These types of systems utilize a compressed spring to drive a piston within a cylinder, thereby compressing air in front of the piston to project the BB from a barrel. The spring can be compressed by human power or by an electric motor.

Polarstar Airsoft, of Newark, Delaware, has developed an HPA powered, solenoid driven, and electronically controlled drop-in replacement engine for an airsoft weapon gearbox, referred to commercially as the Fusion Engine. The Fusion Engine is shown and described in U.S. Patent Publication No. 2012/0192847. The drop-in engine described in the referenced patent publication is driven by a tank of compressed gas, such as compressed air, that is typically worn on the back of the player. The tank connects to the drop-in engine through a hose connected to the engine near the bottom of the pistol grip. The source of pressurized air and a regulator are typically worn on the back of the player and carried in some type of backpack arrangement. Although this type of compressed gas supply functions adequately, it requires the player to have a hose running from the backpack to the pistol grip of the airsoft rifle.

SUMMARY

The present disclosure relates to an air supply system for use with an airsoft gun. More specifically, the present disclosure relates to an air supply system that includes a regulator supported by the body of the airsoft gun that modifies the pressure of a gas, such as air, nitrogen, carbon dioxide or propane, used to drive the pneumatic engine within the airsoft gun.

The pressure regulator of the air supply system is supported by the receiver of the airsoft gun such that the pressure regulator moves along with the rest of the airsoft gun. The pressure regulator includes an adjustment dial that can be used to control the pressure of gas supplied to the airsoft gun from the pressure regulator. A protective cover can be positioned over the adjustment dial. The protective cover can receive a security device which will limit access to the adjustment dial until the protective cover is removed. The protective cover can be secured to the airsoft gun using a tamper-evident security device to prevent adjustment of the pressure of gas leaving the pressure regulator.

In one embodiment of the disclosure, the bottle of pressurized gas is supported on the receiver and located above a stock that is also mounted to the receiver. The stock can include a support bracket spaced from the receiver by a pair of support rods. The pressure regulator is mounted to the support bracket and is thus spaced from the receiver.

In another contemplated embodiment, the pressure regulator can be mounted between the bottle of pressurized gas and the receiver. In such an embodiment, the pressure regulator supports the bottle of pressurized gas above a stock also mounted to the receiver.

In another contemplated embodiment, the pressure regulator can be located within a pistol grip of the receiver. The adjustment dial of the pressure regulator is accessible through a bottom end of the pistol grip to allow adjustment of the output pressure from the pressure regulator. In such an embodiment, the bottle of pressurized gas is supported by the receiver above a stock.

In another contemplated embodiment, the pressure regulator can be mounted between the bottle of pressurized gas and the receiver. In such an embodiment, the pressure regulator supports the bottle of pressurized gas and a stock is configured to surround the bottle of pressurized gas. In this embodiment, the bottle of pressurized gas provides the required support for the stock.

In another contemplated embodiment, the pressure regulator can be mounted between the bottle of pressurized gas, such as air, nitrogen, carbon dioxide, propane or other compressed gas, and the receiver. In such an embodiment, the pressure regulator supports the bottle of pressurized gas and a stock is mounted to a rear end of the bottle of pressurized gas. In such an embodiment, the stock is supported by the bottle and is held in place on the back end of the bottle of pressurized gas through a friction connection.

In another contemplated embodiment, the pressure regulator can be mounted between the bottle of pressurized gas and the receiver. In such an embodiment, the pressure regulator supports the bottle of pressurized gas and a stock is configured to mount to the rear end of the bottle of pressurized gas. In this embodiment, a pair of support rods is used to further support the stock and the bottle of pressurized gas.

In yet another contemplated embodiment, the pressure regulator can be mounted between the bottle of pressurized gas and the receiver. In such an embodiment, a support rail is mounted to the pressure regulator and is configured to receive an adjustable stock. The stock surrounds the bottle of pressurized gas and slides along the length of the support rail. In this manner, the support rail supports the stock which is movable along the length of the bottle of pressurized gas.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Figure 1:
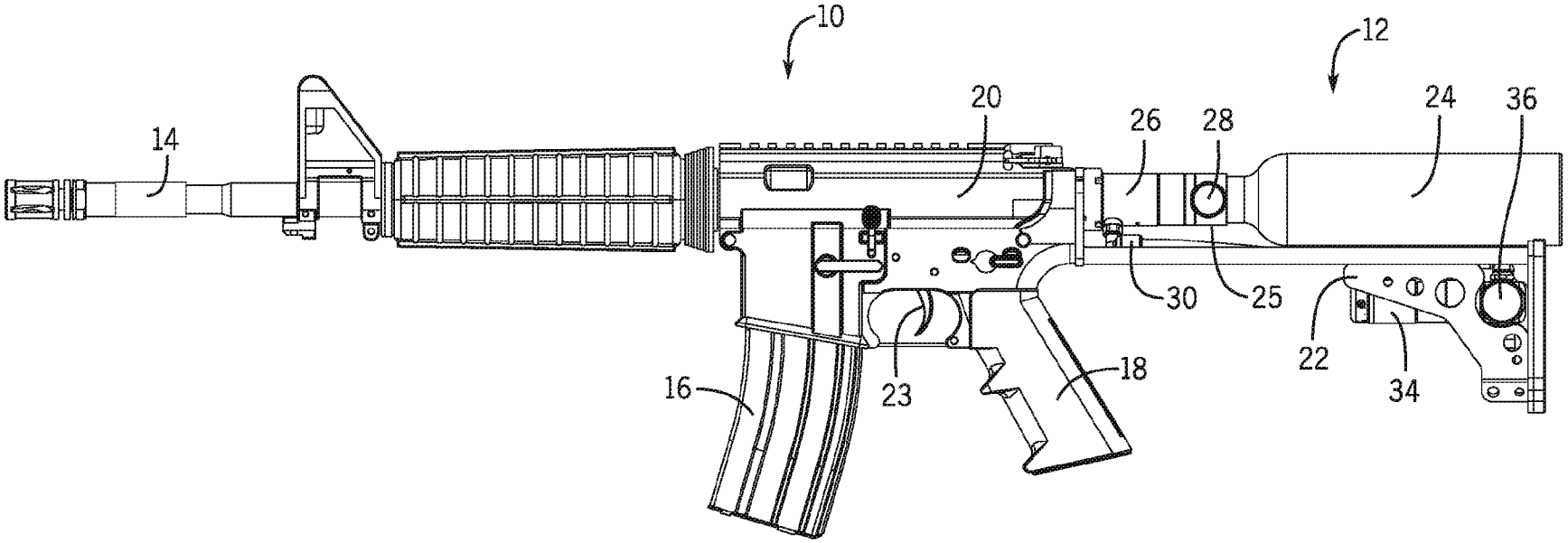
FIG. 1 is a side view of a first embodiment of an airsoft gun incorporating the mounted air supply in accordance with a first embodiment of the present disclosure.

FIGS. 1-4 illustrate a first embodiment of an airsoft gun 10 utilizing the gun mounted gas supply system 12 of the present disclosure. The airsoft gun 10 shown in FIG. 1 has been designed to replicate the overall appearance of an AR-15. The airsoft gun 10 includes a barrel 14, a magazine 16, a pistol grip 18, a receiver 20 and a stock 22. The AR-15 shown in the drawing figures includes an upper receiver and a lower receiver, the combination of which are referred to as the receiver 20. Other models of firearms could include only a one-piece receiver. In the embodiment shown in FIG. 1, the gas supply system utilizes a compressed air source although other gases, such as nitrogen, carbon dioxide or propane are contemplated. The compressed gas supply for the gas supply system 12 is supported by the airsoft gun 10 and mounted to the stock 22 such that the airsoft gun 10 and the gas supply system 12 can be utilized without any additional tubing or hoses running to the air supply system.

As indicated above, the airsoft gun 10 shown in FIGS. 1-4 incorporates the Fusion Engine available from Polarstar, which is described in U.S. Patent Publication No. 2012/0192847, the disclosure of which is incorporated herein by reference. As indicated above, the drop-in engine is contained within the receiver 20 and is powered by the gas supply system 12 and propels BBs contained within the magazine 16 through the barrel 14 upon depression of the trigger 23. The drop-in engine is pneumatically powered and solenoid driven by an electronic control assembly. Although the Fusion Engine is shown in the preferred embodiment, the air supply system of the present disclosure could be used with other air powered airsoft guns, such as but not limited to Daytona Guns, classic gas blow back guns and hybrid gas blow back guns.

Figure 4:
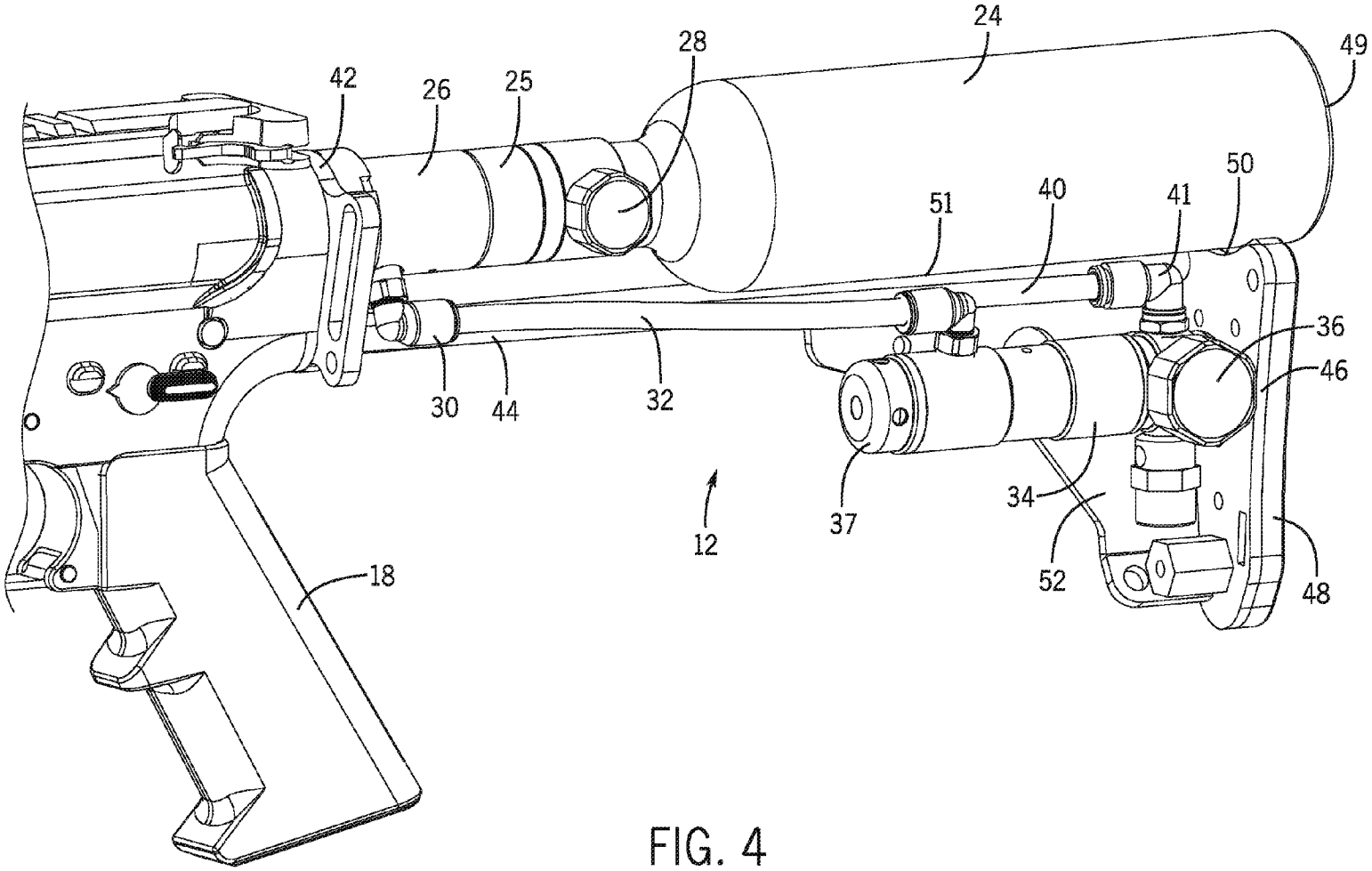
FIG. 4 is a magnified view similar to FIG. 3 further illustrating the position of the regulator.
Figure 4A:
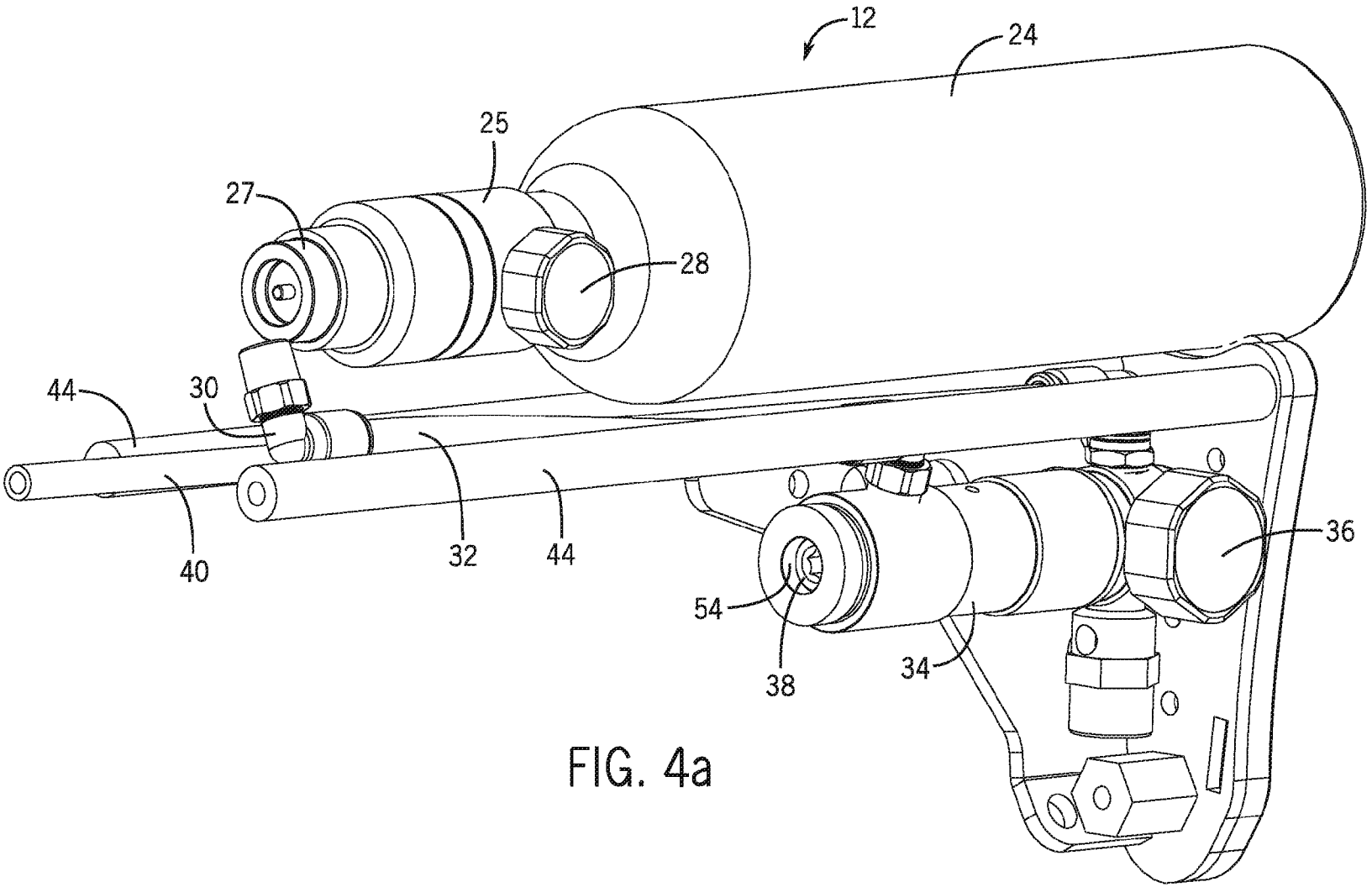
FIG. 4*a* is a view similar to FIG. 4 with various components hidden to show internal components of the mounted regulator.
Figure 5:
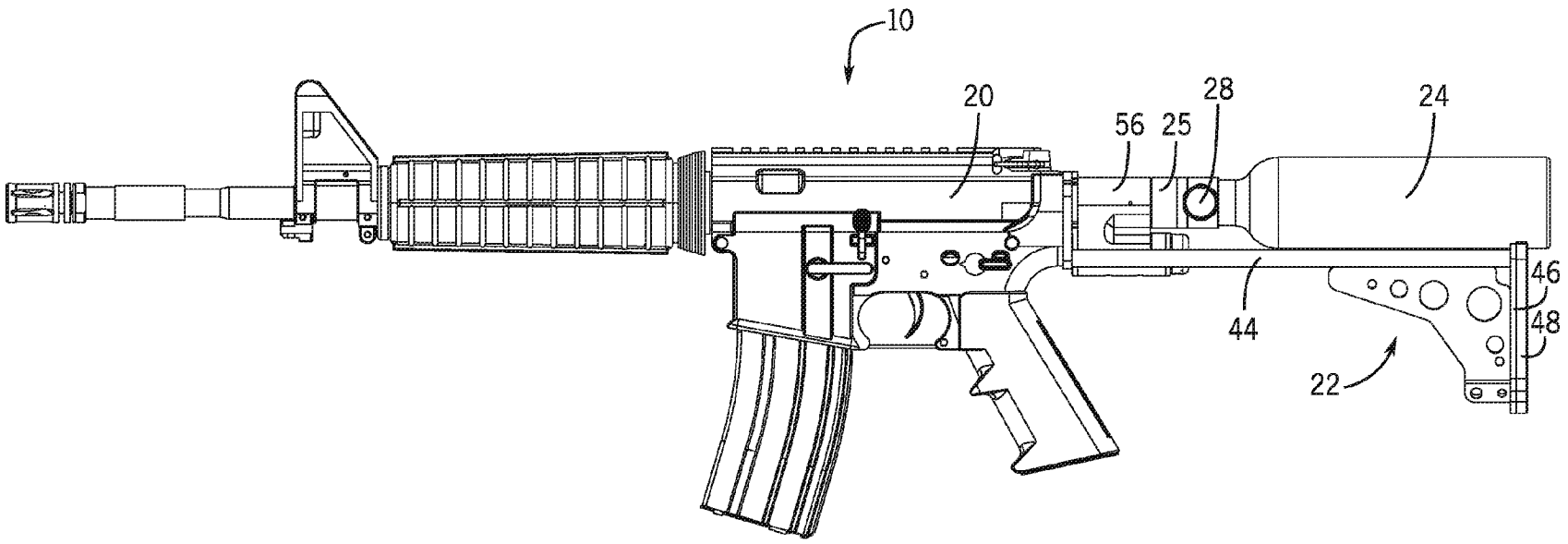
FIG. 5 is a side view of a second embodiment of an airsoft gun incorporating the mounted compressed gas supply of the present disclosure.
Figure 6:
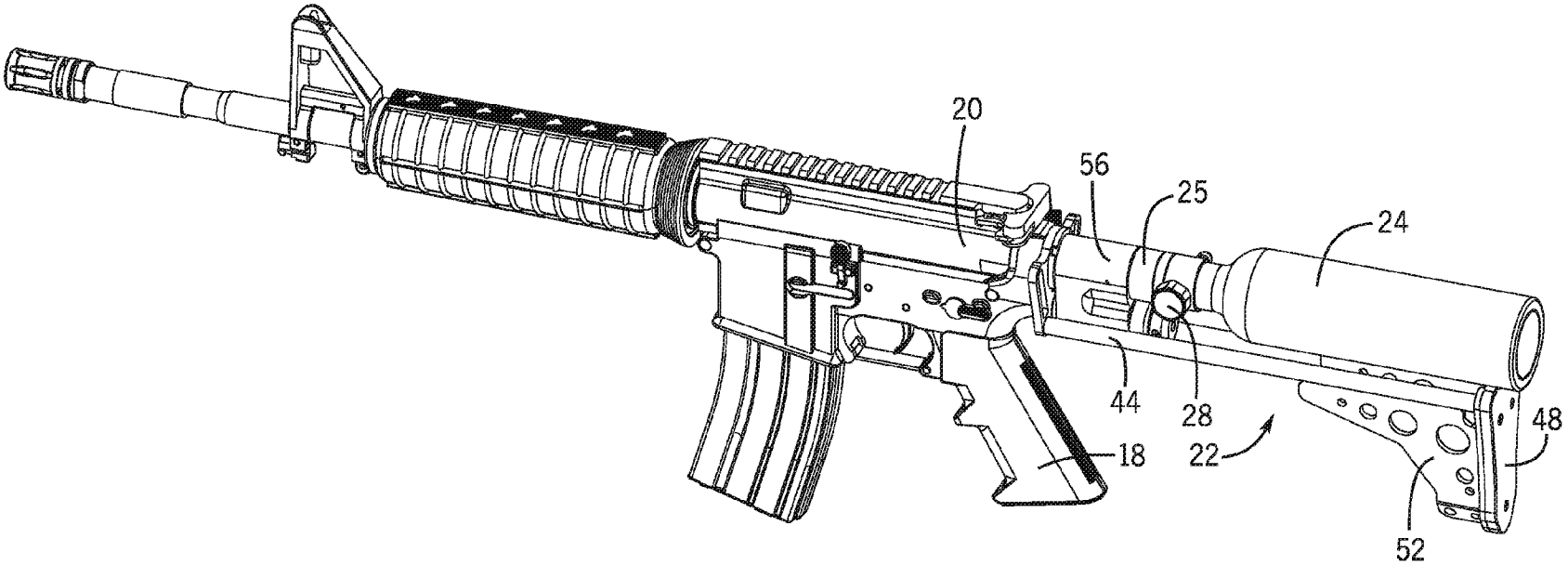
FIG. 6 is a perspective view of the second embodiment shown in FIG. 5.
Figure 7:
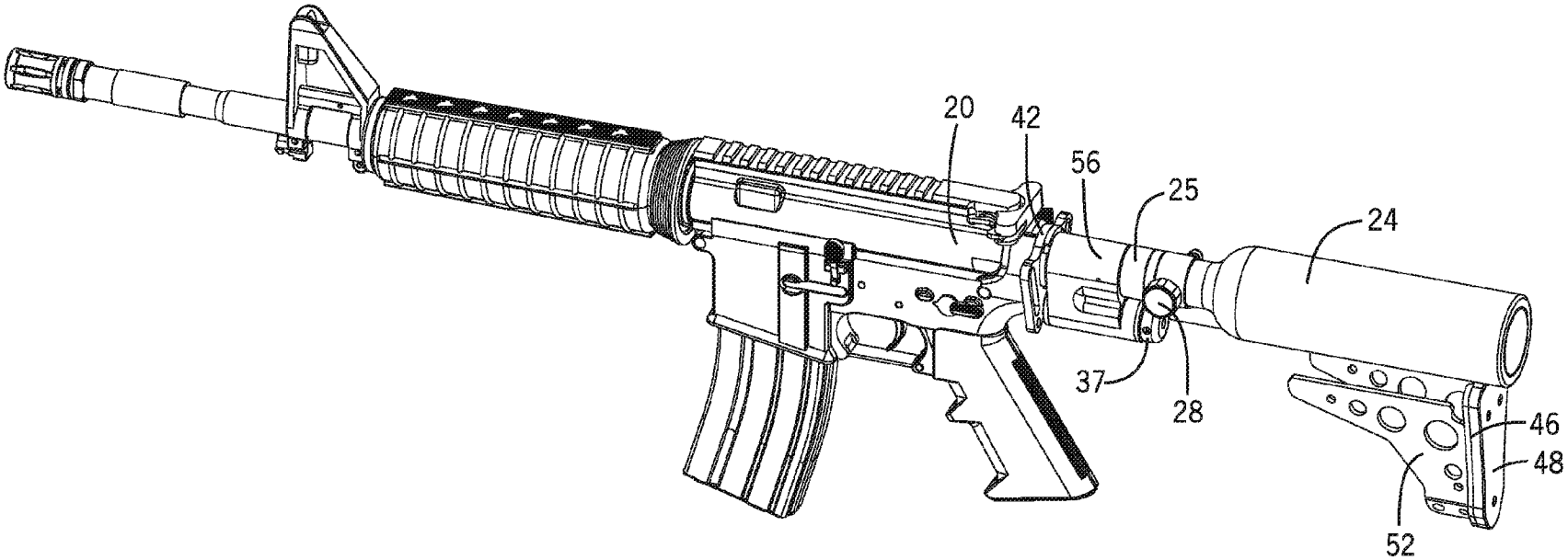
FIG. 7 is a view similar to FIG. 6 with several of the components removed to illustrate the position of the regulator.

As best shown in FIG. 4*a*, the gas supply system 12 includes a high pressure tank or container, such as a bottle 24 of a compressed gas, such as air, having a tank regulator 25, a fill nipple 27 and a pressure gauge 28. The tank regulator 25 regulates the pressure of gas from the high pressure bottle 24 to a fixed output pressure typically between 300 and 900 psi, which is chosen at the time of purchase. Although a bottle 24 is shown, other types of tanks or containers could be used within the scope of the present disclosure.

As shown in FIGS. 1-4, a connecting sleeve 26 is located between the tank regulator 25 and the airsoft gun 10. The connecting sleeve 26 includes an outlet fitting 30 having a supply hose 32, as best shown in FIG. 4. The supply hose 32 feeds pressurized air or other gas to a regulator 34. The regulator 34 includes a second pressure gauge 36. The regulator 34 further includes a protective cover 37 positioned over an adjustment dial for the regulator. The protective cover 37 is removed in FIG. 4*a* such that the adjustment dial 38 is shown. The adjustment dial 38 can be manipulated by the user to adjust the pressure of gas leaving the regulator 34. As shown in FIG. 4, the gas leaving the regulator 34 is supplied to the airsoft gun through the return hose 40 connected to an outlet air fitting 41 of the regulator 34. The return hose 40 enters into the receiver 20 and provides pneumatic power to the drop-in engine contained within the receiver 20.

Referring back to FIG. 4, a mounting bracket 42 is positioned at the back end of the receiver 20 and provides a point of attachment for both the sleeve 26 and a pair of support rods 44. The support rods 44 extend to a support bracket 46 that includes a shoulder pad 48. The support bracket 46 can, in some instances, serve as a shoulder stock. Additionally, the butt end 49 of the bottle 24 could also be placed against the shoulder of the operator and used as a shoulder support.

Figure 2:
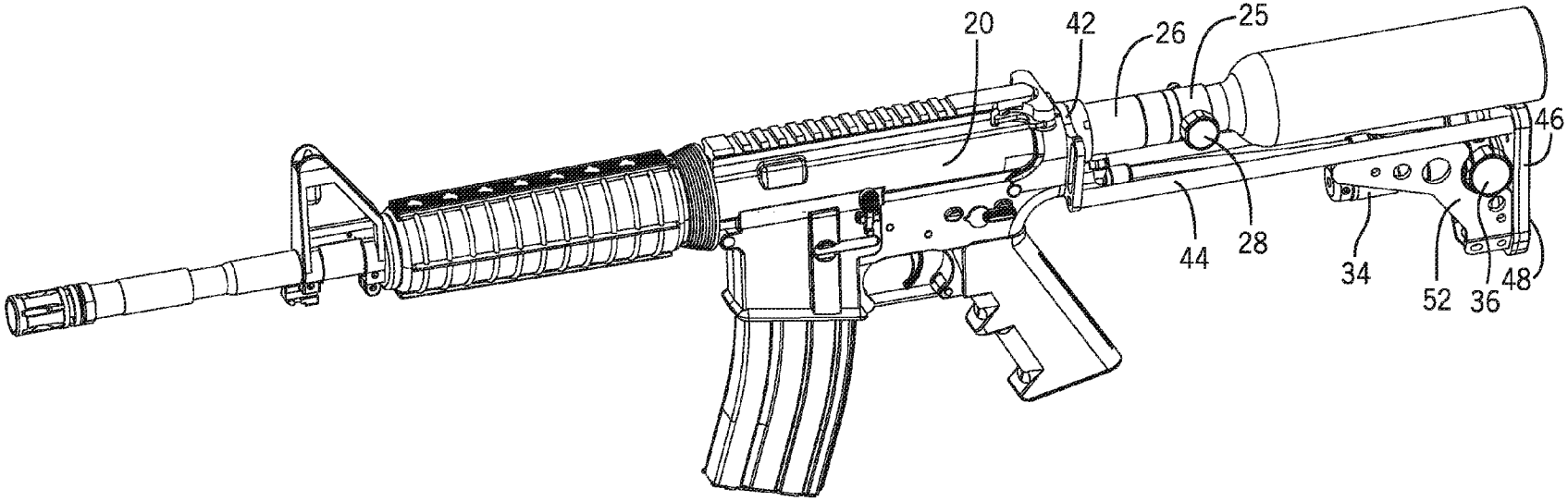
FIG. 2 is a perspective view illustrating the first embodiment shown in FIG. 1.
Figure 3:
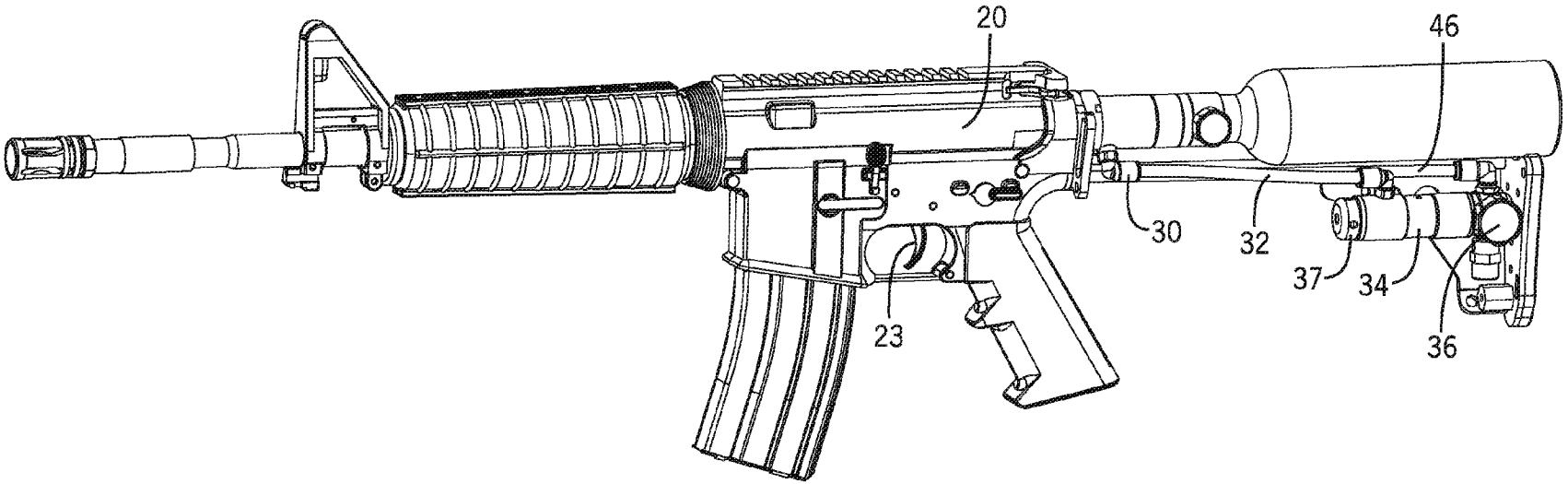
FIG. 3 is a view similar to FIG. 2 with one of the side brackets removed to illustrate the regulator.

As illustrated in FIG. 4, the support bracket 46 includes an upper surface 50 designed to be closely spaced from the curved, cylindrical outer surface 51 of the bottle 24. The bottle 24 is supported relative to the airsoft gun by the threaded connection between the bottle 24 and the receiver of the airsoft gun 10. The support bracket 46 provides a point of attachment for the regulator 34 such that the regulator 34 is also mounted to the airsoft gun. A pair of side brackets 52 partially encloses the regulator, as shown in FIG. 2. The side brackets 52 are preferably formed from a metallic material that is both durable and lightweight. It is contemplated that the bottle 24 could be carried by the operator and connected to the regulator 34 that is supported by the airsoft gun 10.

As shown in FIG. 4*a*, the regulator 34 includes the adjustment dial 38 having an access opening 54 that allows the user to adjust the pressure of air leaving the regulator through the return hose 40. The regulator 34 thus allows the user to reduce the pressure of gas present within the supply tube 32 that is connected to and fed by the high pressure bottle 24. In this manner, the regulator 34 can control the exit velocity of BBs from the airsoft gun 10. When the protective cover 37 is installed as shown in FIG. 4, the user can install a security device, such as a zip tie or similar device, to restrict the ability to insert a tool into the access opening 54. When the security device is installed and the protective cover 37 is in place, the user is unable to change the pressure of the air supplied to the drive engine of the airsoft gun. During competition, the protective cover 37 can be connected to the airsoft gun by a security devices, such as a plastic tie or other device, to prevent the operator for changing the air pressure during the competition.

FIGS. 5-8 illustrate a second embodiment of the airsoft gun 10. In the embodiment shown in FIGS. 5-8, a regulator 56 is positioned directly between the tank regulator 25 connected to the bottle 24 and the rear end of the receiver 20. The stock 22 still includes the pair of support rods 44, the support bracket 46 and the shoulder pad 48. However, in the embodiment shown in FIG. 5, the regulator 56 is no longer attached to the support bracket 46 as in the first embodiment and instead is positioned directly between tank regulator 25 and the receiver 20.

Figure 8:
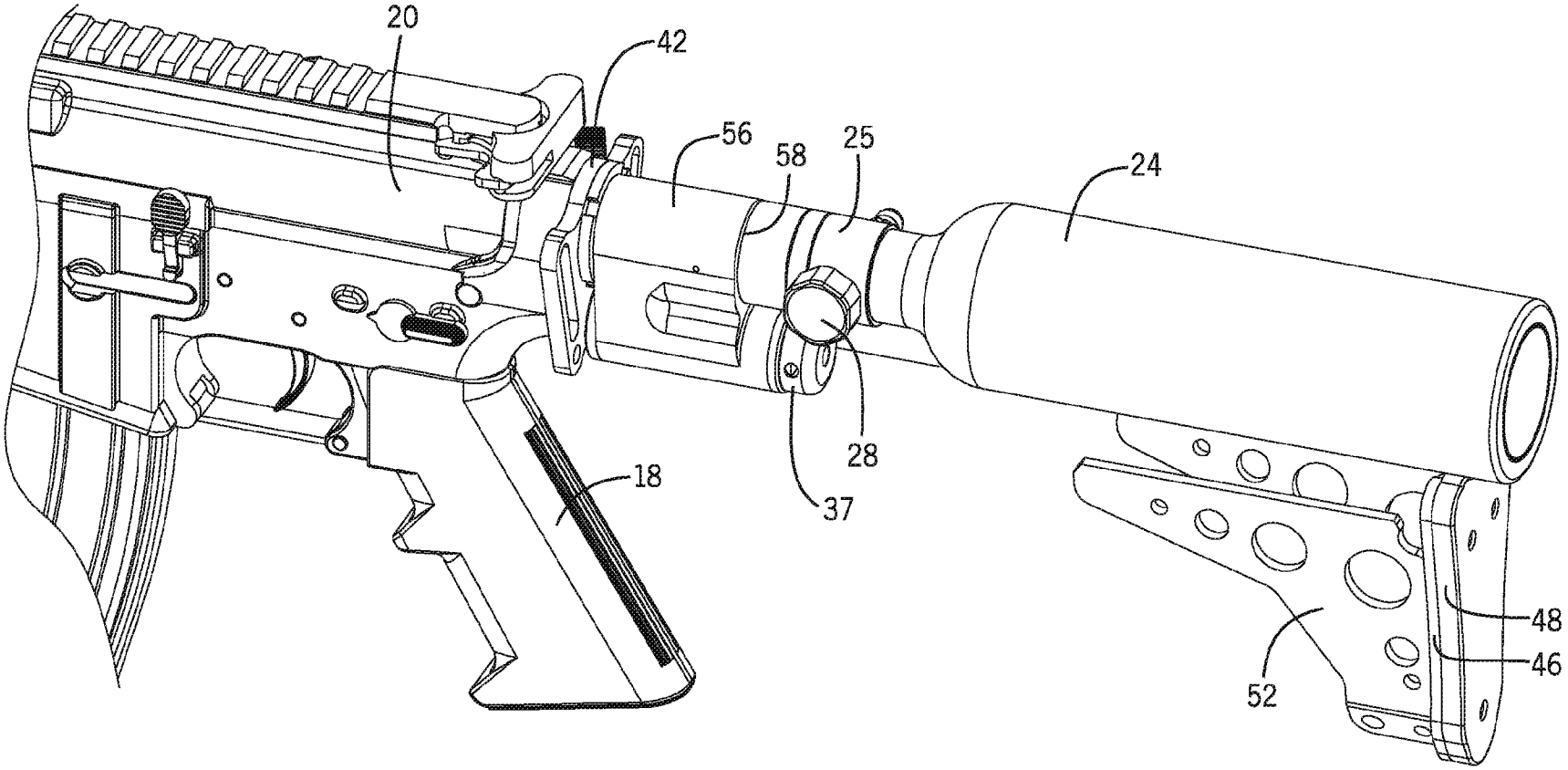
FIG. 8 is a magnified view similar to FIG. 7.
Figure 9:
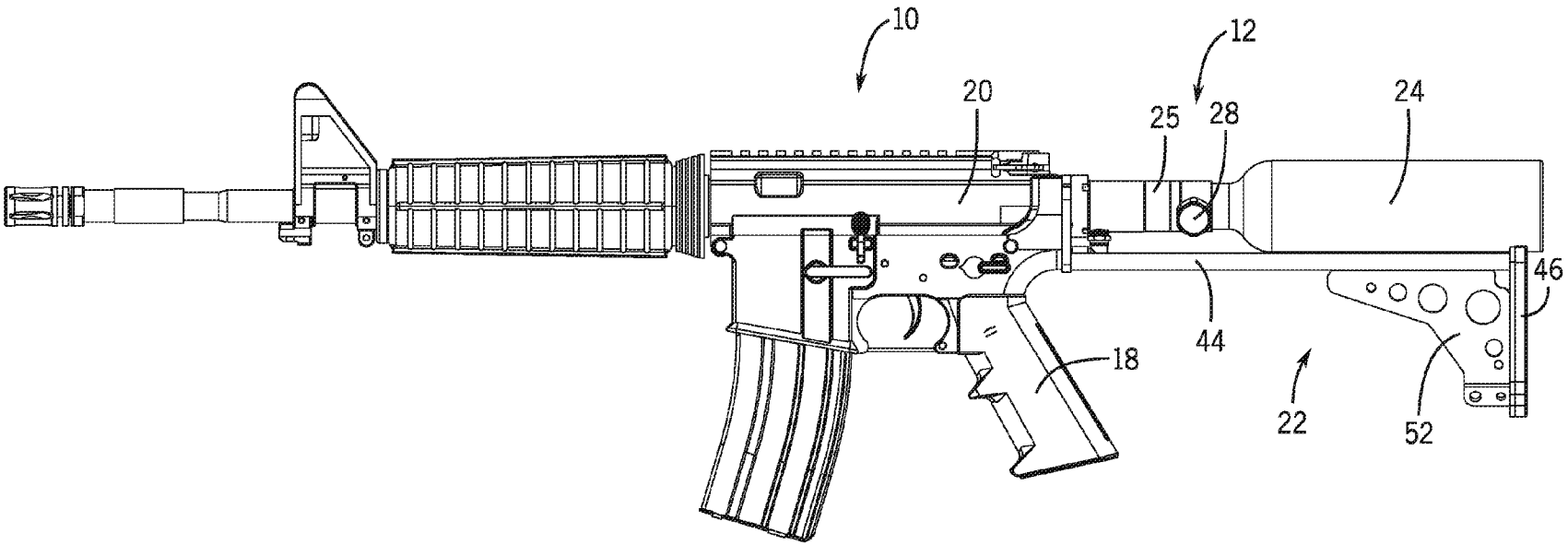
FIG. 9 is a side view of a third embodiment of the airsoft gun including the mounted gas supply and regulator.

As best illustrated in FIG. 8, the regulator 56 includes an upper attachment portion 58 and the lower adjustment dial shown covered by the protective cover 37. The adjustment dial in the embodiment shown in FIG. 8 is similar to the adjustment dial shown in FIG. 4*a* in that the adjustment dial includes an opening 54 that allows the user to adjust the pressure of air entering into the receiver. The embodiment shown in FIGS. 6-8 eliminates the pair of hoses 32 and 40 shown in the first embodiment of FIGS. 1-4.

Although the second embodiment shown in FIGS. 5-8 moves the location of the regulator 56 to a location between the tank regulator 25 and the receiver 20, the airsoft gun 10 still includes the pair of support rods 44 extending from the mounting bracket 42 attached to the receiver to the support bracket 46. The support bracket 46 includes the shoulder pad 48 as well as the pair of side brackets 52. The support bracket 46 is once again designed to correspond to the curved outer surface of the bottle 24.

The regulator 56 shown in FIG. 8 includes internal gas passageways that allow the pressurized gas from the bottle 24 to pass through the regulator 56 and be reduced in pressure based upon the position of the adjustment dial. As in the first embodiment shown in FIGS. 1-4, the embodiment of FIGS. 5-8 allows the entire gas supply system to be mounted directly to the receiver 20 and thus carried as part of the airsoft gun 10.

FIGS. 9-13 illustrate a third embodiment for the gas supply system 12 of the present disclosure. Like the embodiments shown in the earlier figures, the embodiment shown in FIG. 9 incorporates the gas supply system 12 directly on the airsoft gun 10. As in the previous embodiments, the gas supply system 12 includes a bottle 24 of pressurized gas supported above the stock 22. The stock 22 includes the pair of support rods 44 each connected to the support bracket 46. The support rods 44 and the support bracket 46 also are connected to a pair of side brackets 52. The bottle 24 includes the tank regulator 25 and the sleeve 26 which includes the pressure gauge 28.

Figure 10:
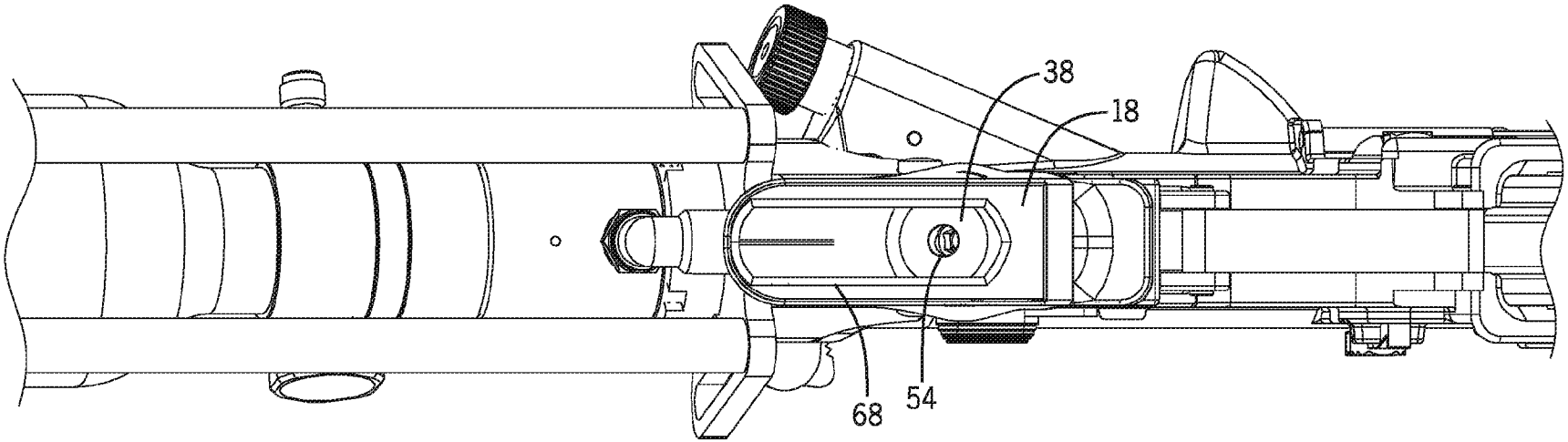
FIG. 10 is a bottom view illustrating the adjustment location for the regulator.
Figure 11:
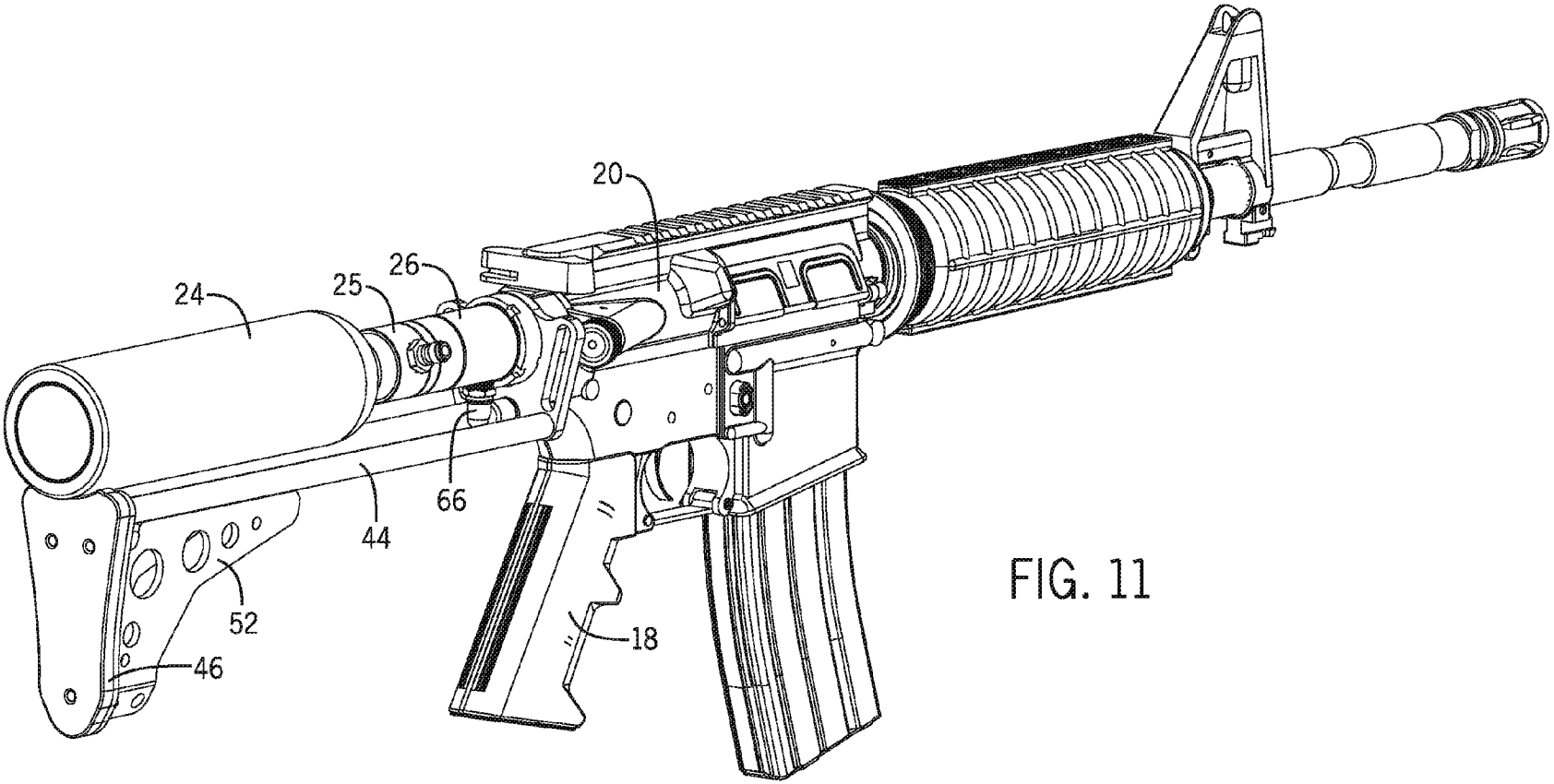
FIG. 11 is a perspective view of the third embodiment showing the connection of the air supply to the regulator.
Figure 12:
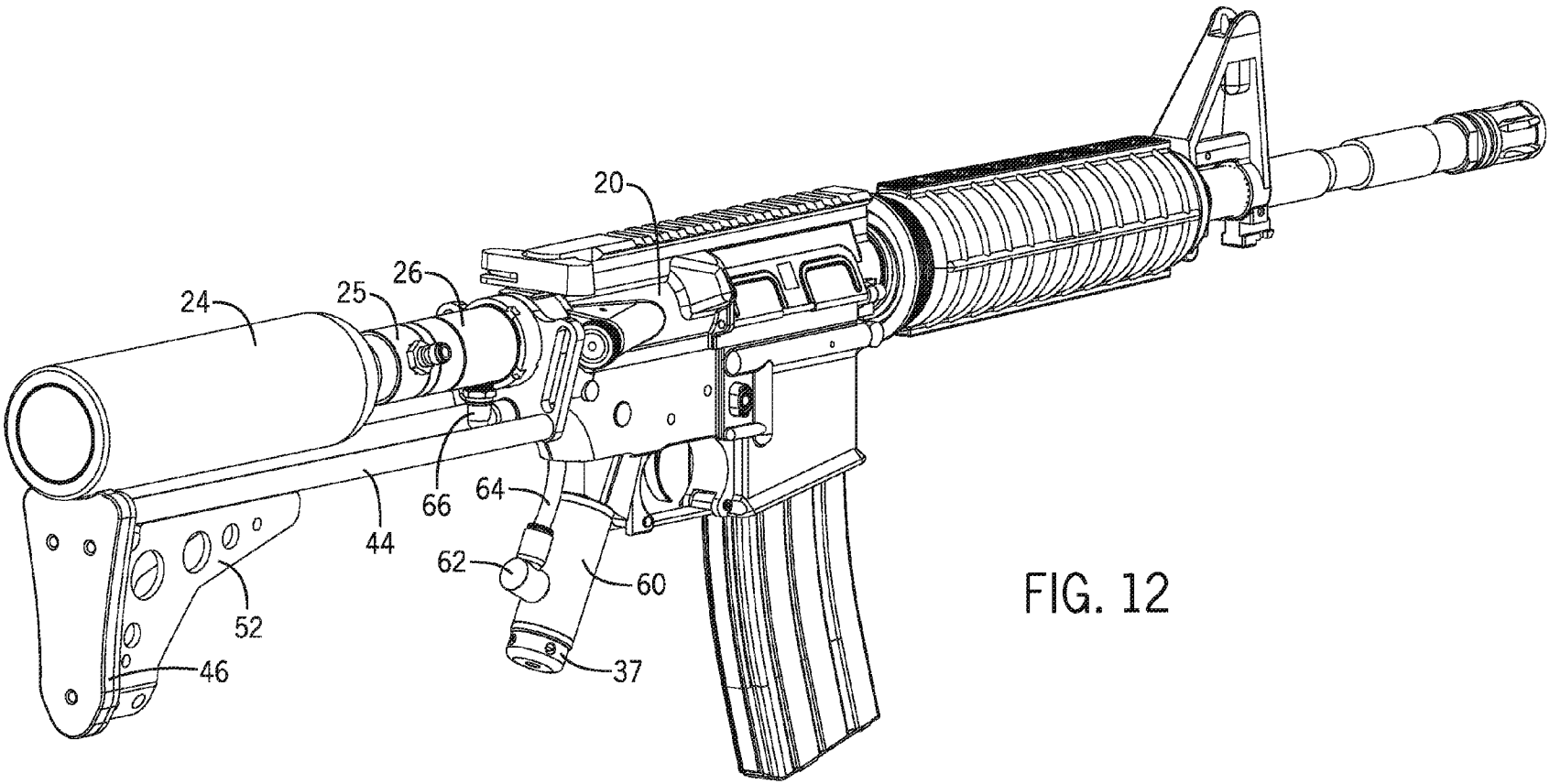
FIG. 12 is a view similar to FIG. 11 with the pistol grip hidden to illustrate the location of the regulator.
Figure 13:
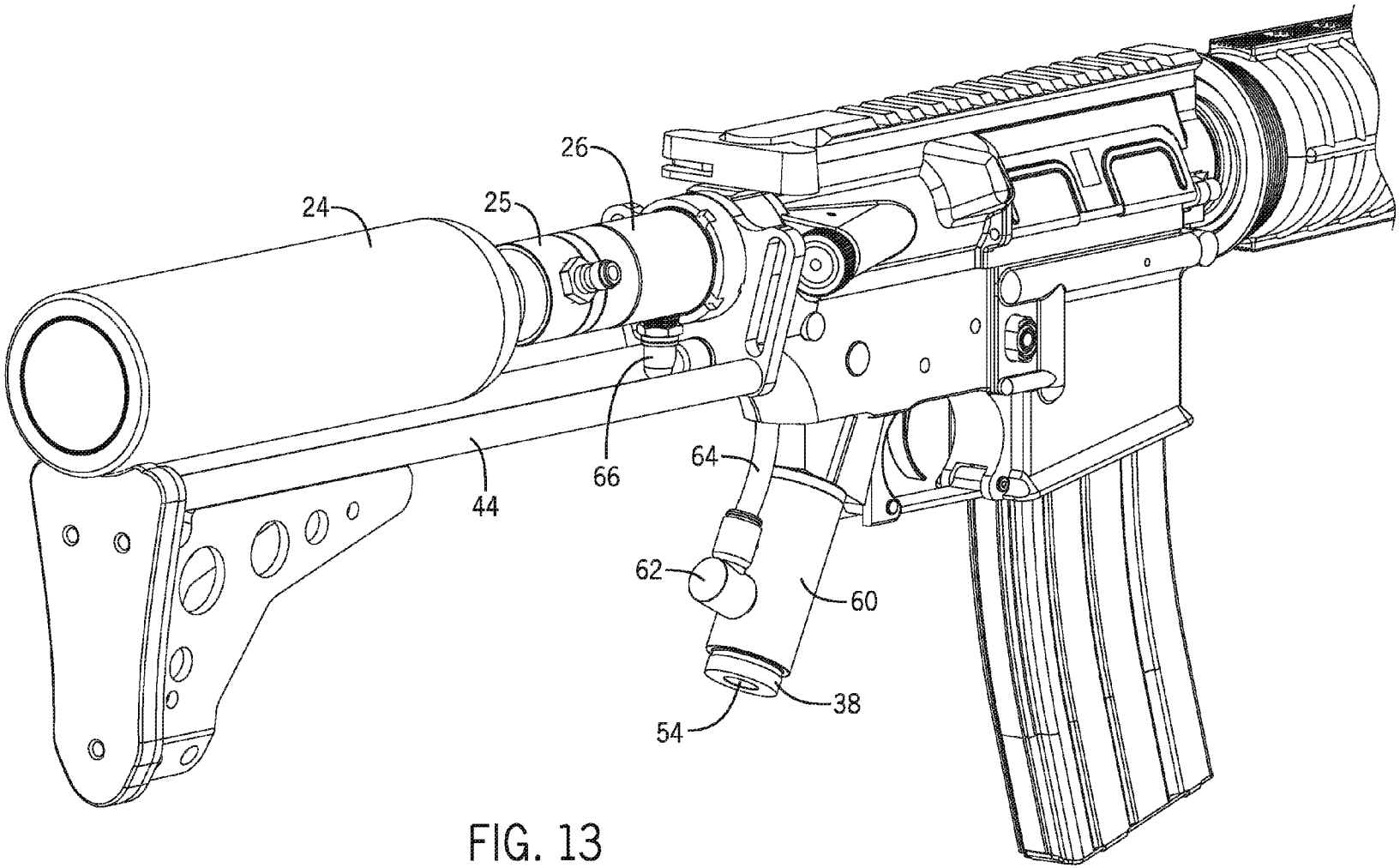
FIG. 13 is a view similar to FIG. 12 further showing the location of the regulator.
Figure 14:
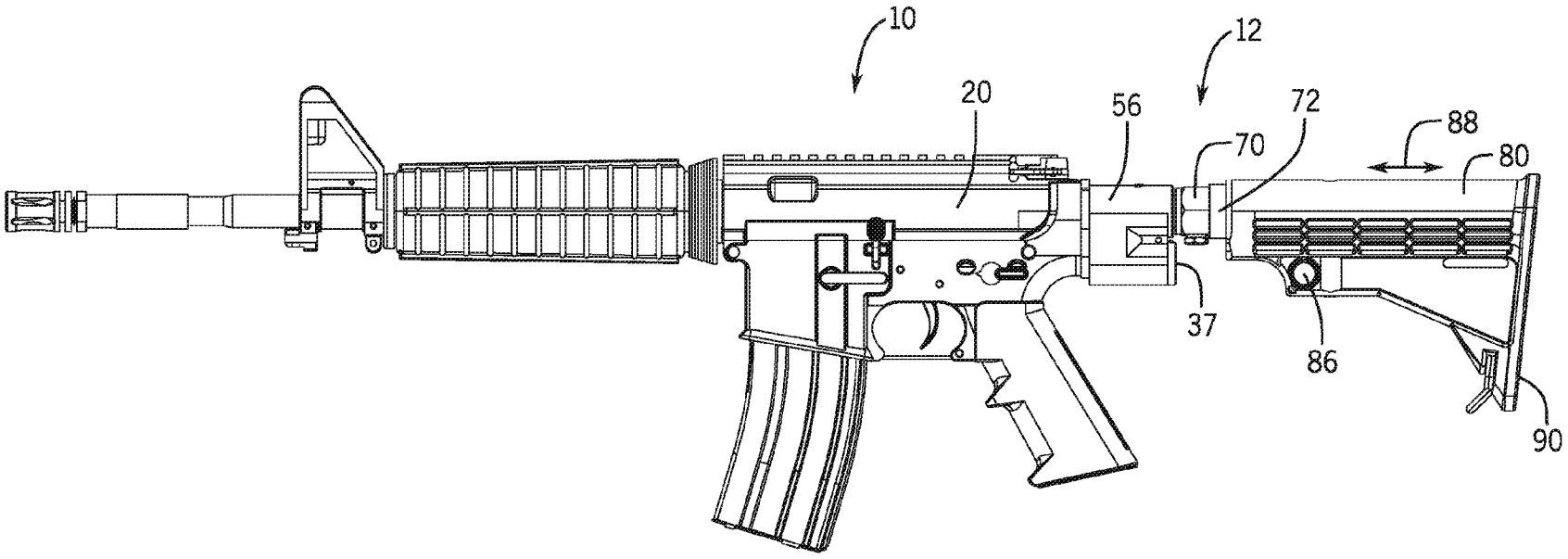
FIG. 14 is a side view of a fourth embodiment of the airsoft gun including the mounted gas supply and regulator.

In the third embodiment, as best shown in FIG. 12, a regulator 60 is contained within the pistol grip 18, shown in FIG. 11. As can be understood in the comparison of FIGS. 11 and 12, the regulator 60 is concealed by the pistol grip 18. The regulator 60 includes a connector 62 that receives the gas supply hose 64. The gas supply hose 64 is connected to the sleeve 26 by the fitting 66 and receives the supply of pressurized gas from the tank 24. The gas supply hose 64 passes through a portion of the receiver 20 and into the regulator 60. The regulator 60 includes the cover 37 that conceals the adjustment dial 38, as can be seen in the comparison of FIGS. 12 and 13. As in the previous embodiments, an opening 54 in the adjustment dial 38 allows the operator to adjust the pressure of gas leaving the regulator 60. As illustrated in FIG. 10, the opening 54 of the adjustment dial 38 is accessible through a lower opening 68 formed in the bottom of the pistol grip 18.

The output of the regulator 60 is connected to the internal engine contained within the receiver 20 to provide pressurized gas to the engine to propel BBs from the airsoft gun.

As can be understood in the FIGS. 9-13, the regulator 60 is concealed within the pistol grip 18 and is accessible through an opening formed in the bottom end of the pistol grip 18.

In the three embodiments shown in the drawing Figures, the entire gas supply system, including the supply of pressurized gas and a regulator, is mounted directly to the airsoft gun 10. In this manner, the disclosure eliminates the need for a backpack mounted supply of pressurized gas, such as air, and external hoses extending from the supply of gas to the airsoft gun. However, a backpack mounted supply of gas could be used and connected to the regulator 60.

In yet another contemplated embodiment, the pressure regulator 60 shown in the pistol grip 18 of FIG. 12 could be incorporated directly into the pneumatic engine contained in the receiver 20. In such an embodiment, the pressure regulator 60 would be integrated into the engine during manufacture of the engine. The pressure regulator 60 would be contained within the receiver 20 and would include an adjustment dial to adjust the pressure of the gas used to drive the pneumatic engine. The adjustment dial could be accessible from the bottom of the pistol grip 18, similar to the embodiment of FIG. 12. Incorporating the pressure regulator 60 directly into the engine would eliminate the hoses that extend from the engine to the regulator in the embodiments shown in the figures of the present disclosure.

Although an AR-15 is shown in all of the embodiments, it is understood that various different airsoft guns could be utilized while operating within the scope of the present disclosure. In accordance with the present disclosure, the entire air supply system is supported and mounted to the airsoft gun such that no external hoses running from the airsoft gun to the supply of pressurized air are needed.

FIGS. 14-17 illustrate a fourth embodiment for the gas supply system of the present disclosure. Like the embodiments shown in the earlier drawing Figures, the embodiment shown in FIG. 14 incorporates the gas supply system 12 directly onto the airsoft gun 20. The gas supply system includes a bottle 72 designed to hold a supply of a pressurized gas. It is contemplated that the pressurized gas could be air, nitrogen, carbon dioxide, propane or any other type of gas that can be pressurized and safely stored and discharged from the pressurized bottle 72. In the embodiment shown, the bottle 72 contains carbon dioxide. In the embodiment shown, the gas supply system 12 shown in FIG. 14 includes the regulator 56 positioned directly between a pin valve 70 connected to the bottle 72 and the rear end of the receiver 20. Although a pin valve 70 is used when the bottle 72 includes carbon dioxide, the pin valve 70 would be replaced with a tank regulator, similar to FIG. 1, when the bottle 72 includes a supply of pressurized air or nitrogen. The regulator 56 includes the upper attachment portion 58 and the lower adjustment dial shown covered by the protective cover 37. The adjustment dial of the regulator 56 allows the user to adjust the pressure of gas or air entering into the receiver 20.

Figure 15:
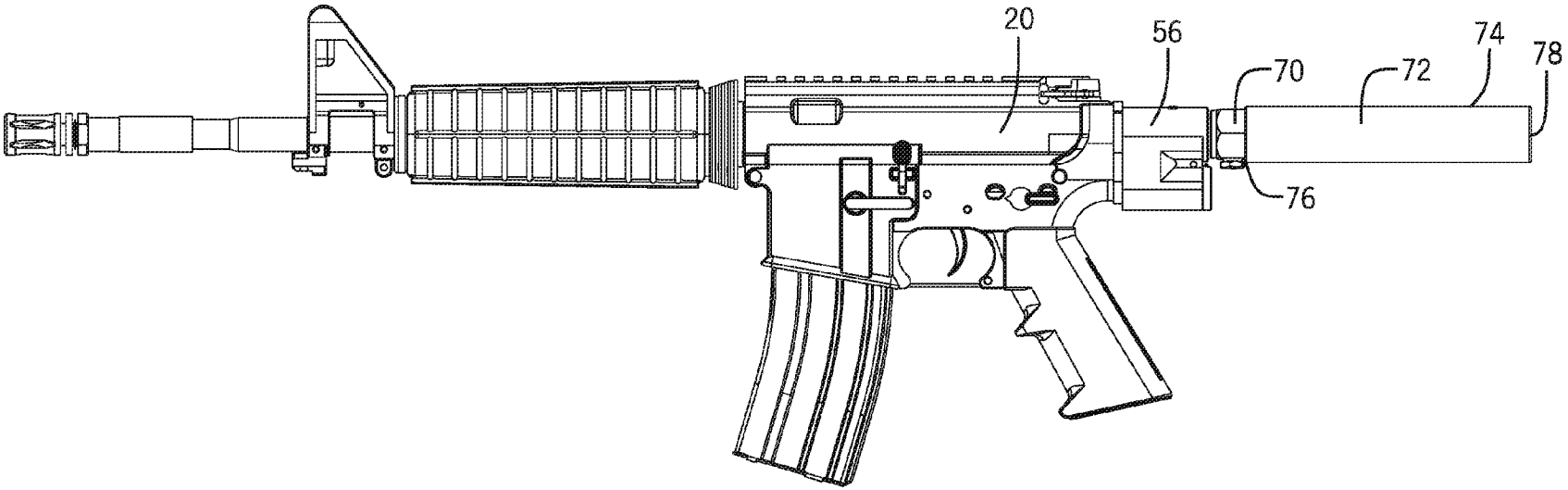
FIG. 15 is a side view with the adjustable stock removed from the gas supply.
Figure 16:
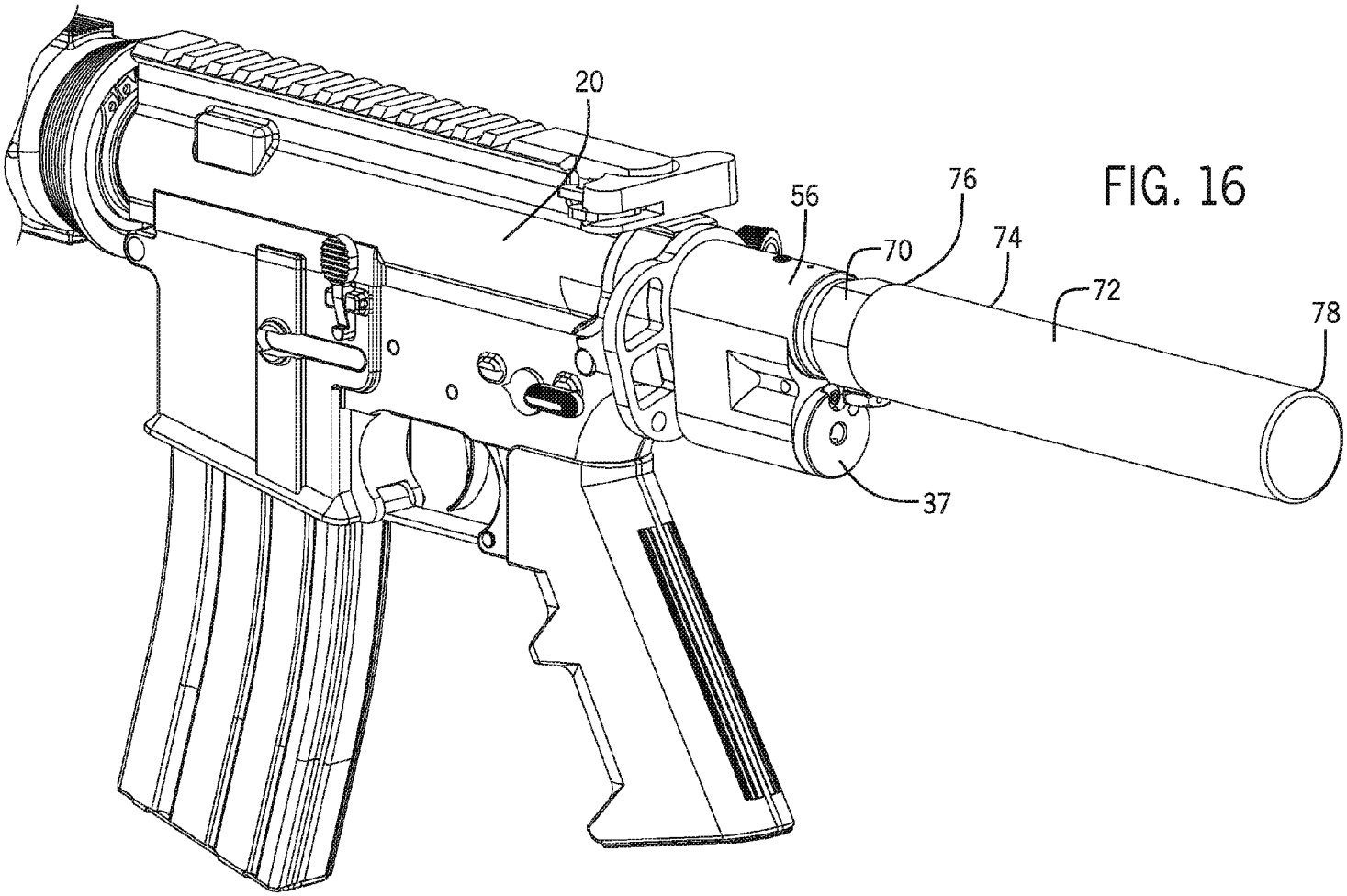
FIG. 16 is a magnified, perspective view showing the mounting of the gas supply to the pressure regulator.

As can be seen in FIGS. 15 and 16, the bottle 72 has a generally constant diameter defined by the outer surface 74. The bottle 72 extends from the first end 76 to a rear, second end 78. As can be best understood in FIGS. 14 and 17, a stock 80 is designed to be received along the outer surface 74 of the bottle 72 such that the bottle 72 provides mounting support for the stock 80.

Figure 17:
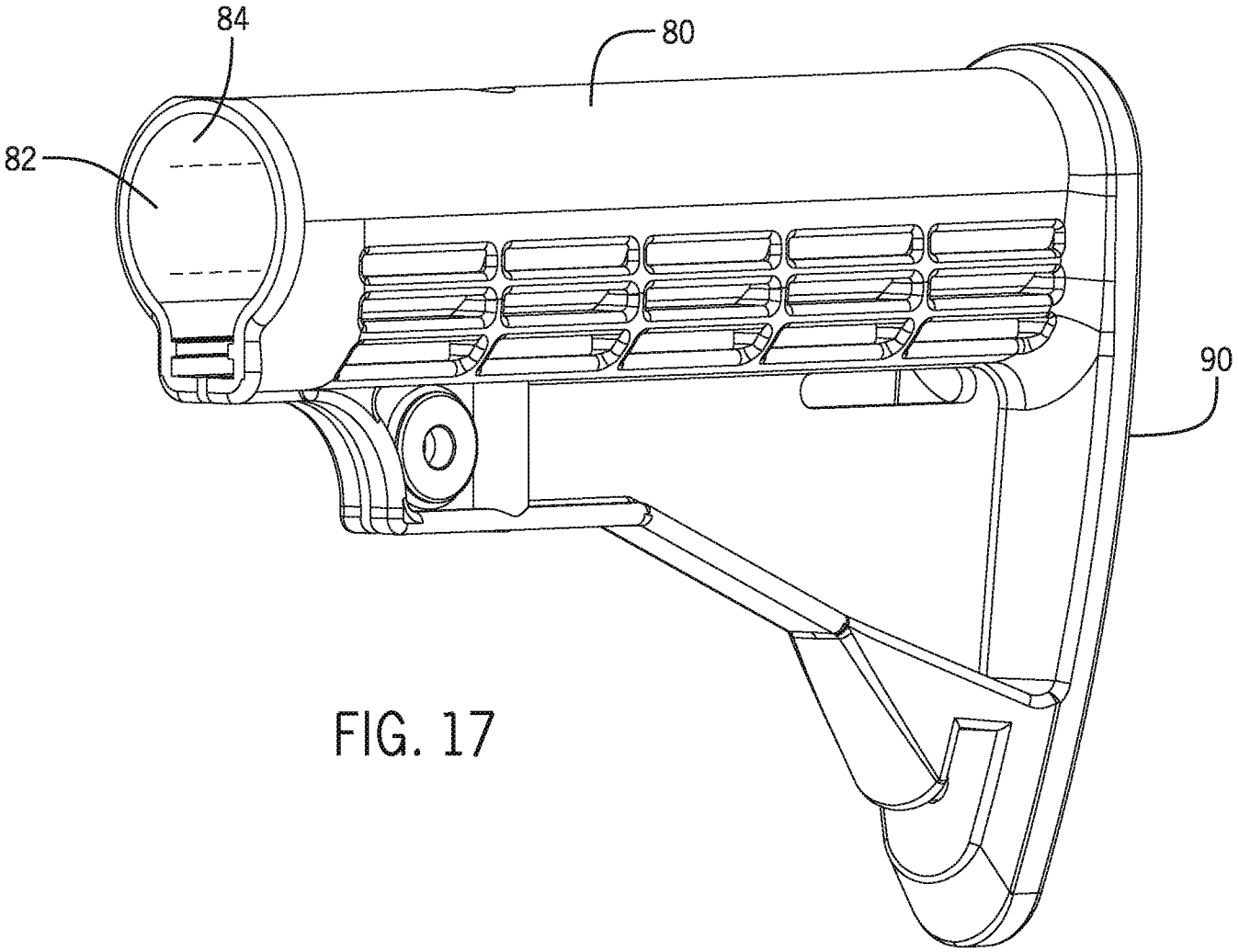
FIG. 17 is a perspective view of the adjustable stock.

Referring now to FIG. 17, the stock 80 includes a receiving tube 82 having an inner surface 84 sized to frictionally receive the outer surface of the bottle. The stock 80 is a two-part molded construction that can be tightened together using an attachment knob 86 shown in FIG. 14. When the adjustment knob 86 is tightened, the two halves of the stock 80 compress to frictionally engage the outer surface of the bottle 72. In this manner, the position of the stock 80 can be adjusted along the length of the bottle 72, as illustrated by arrow 88 in FIG. 14, and secured in the desired location based on user preference.

The stock 80 includes a shoulder pad 90, as in the previous embodiments. As can be understood in the embodiment shown in FIGS. 14-17, the stock 80 is supported along the bottle 72, which in turn is supported by the regulator 56.

Figure 18:
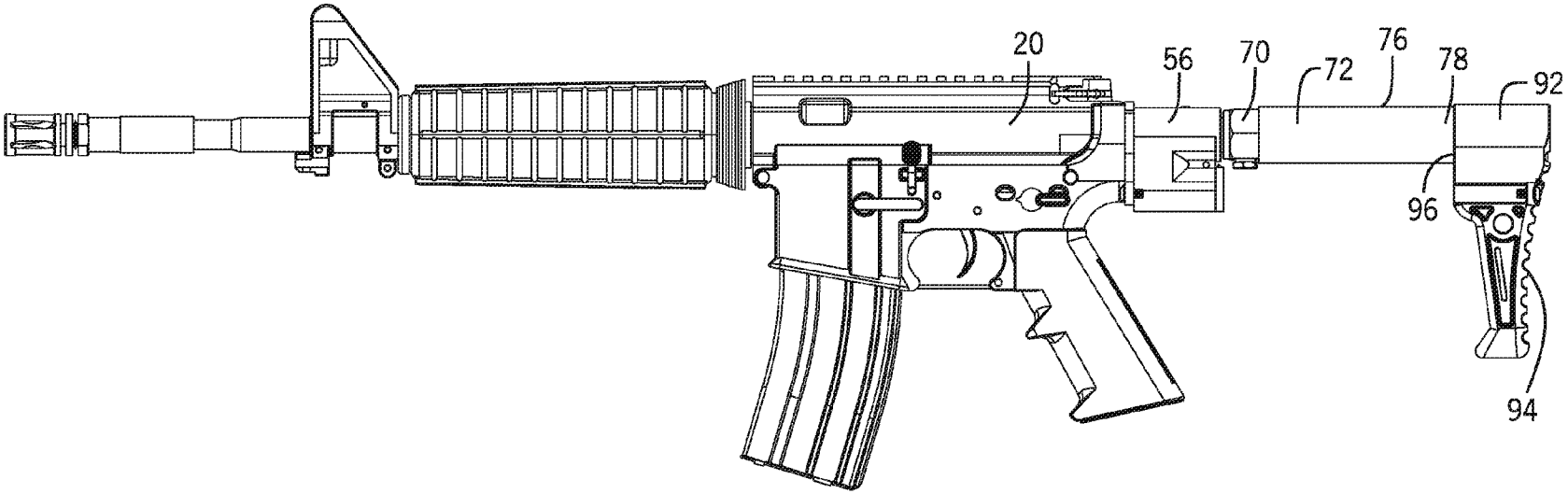
FIG. 18 is a side view of a fifth embodiment of the airsoft gun including the mounted gas supply, regulator and stock.

FIG. 18 illustrates a fifth embodiment of the present disclosure. In the embodiment shown in FIG. 18, a modified stock 92 is mounted to the second, back end 78 of the bottle 72. The stock 92 includes a shoulder pad 94 and an internal receiving tube 96. The internal receiving tube 96 is sized to frictionally engage the outer surface 76 of the bottle 72. In the embodiment shown in FIG. 18, the stock 92 is supported by the bottle 72, which in turn is supported by the pressure regulator 56 mounted to the rear end of the receiver 20.

Figure 19:
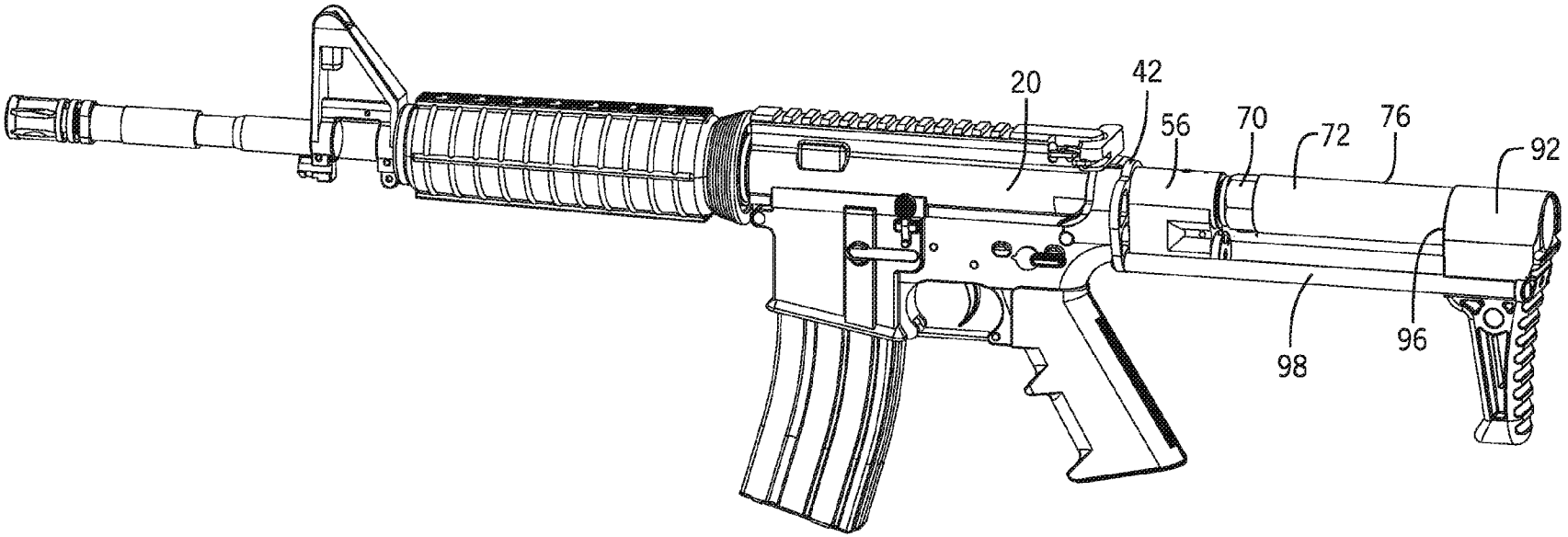
FIG. 19 is a perspective view of a sixth embodiment showing the connection between the gas supply and the regulator with a supported stock.
Figure 20:
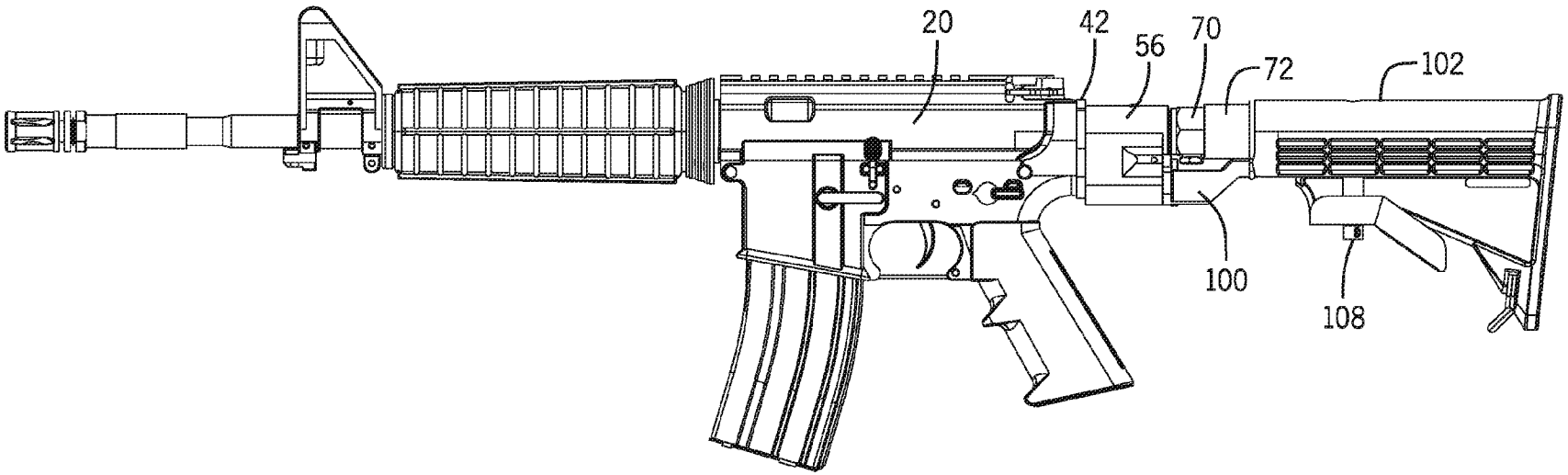
FIG. 20 is a seventh embodiment of the airsoft gun including the pressure regulator, gas supply and adjustable stock.
Figure 21:
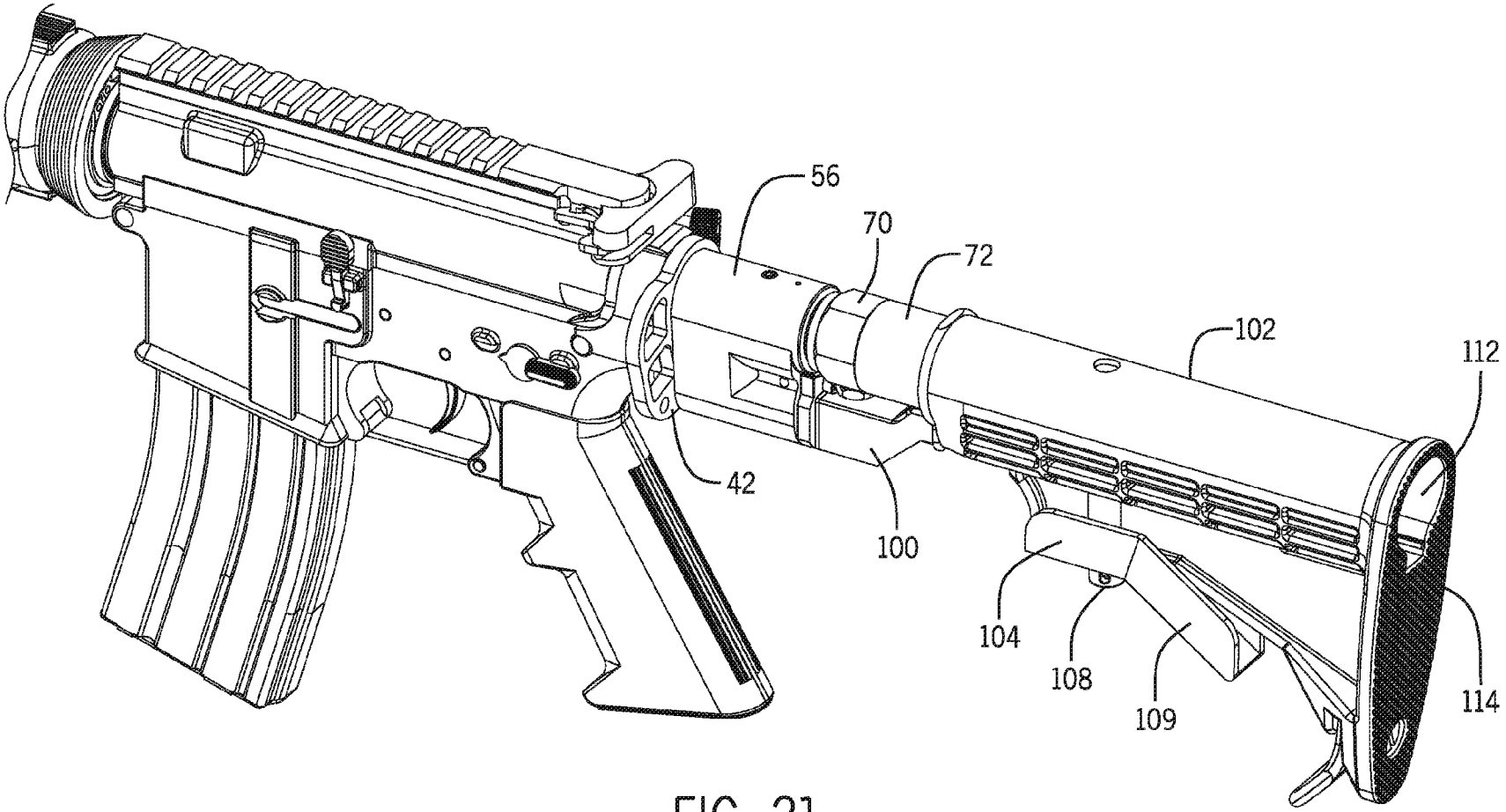
FIG. 21 is a magnified perspective view similar to FIG. 20.

FIG. 19 illustrates a sixth embodiment of the present disclosure. The embodiment shown in FIG. 18 is similar to the embodiment of FIG. 18. However, in the embodiment shown in FIG. 19, a pair of support rods 98 are connected between the mounting bracket 42 and the stock 92 to provide support for the stock 92. The stock 92 includes the internal tube 96 that is sized to be received along the outer surface 76 of the bottle 72 in a slip fit. The support rods 98 provide support for the stock and thus provide additional support for the weight of the bottle 72.

FIGS. 20-23 illustrate a seventh embodiment of the present disclosure. In the seventh embodiment, the pressure regulator 56 is again mounted to the back end of the receiver 20 through the mounting bracket 42. However, unlike the embodiment shown in FIGS. 14-17, the embodiment of FIGS. 20-23 incorporate a support rail 100 mounted to the pressure regulator 56.

Figure 23:
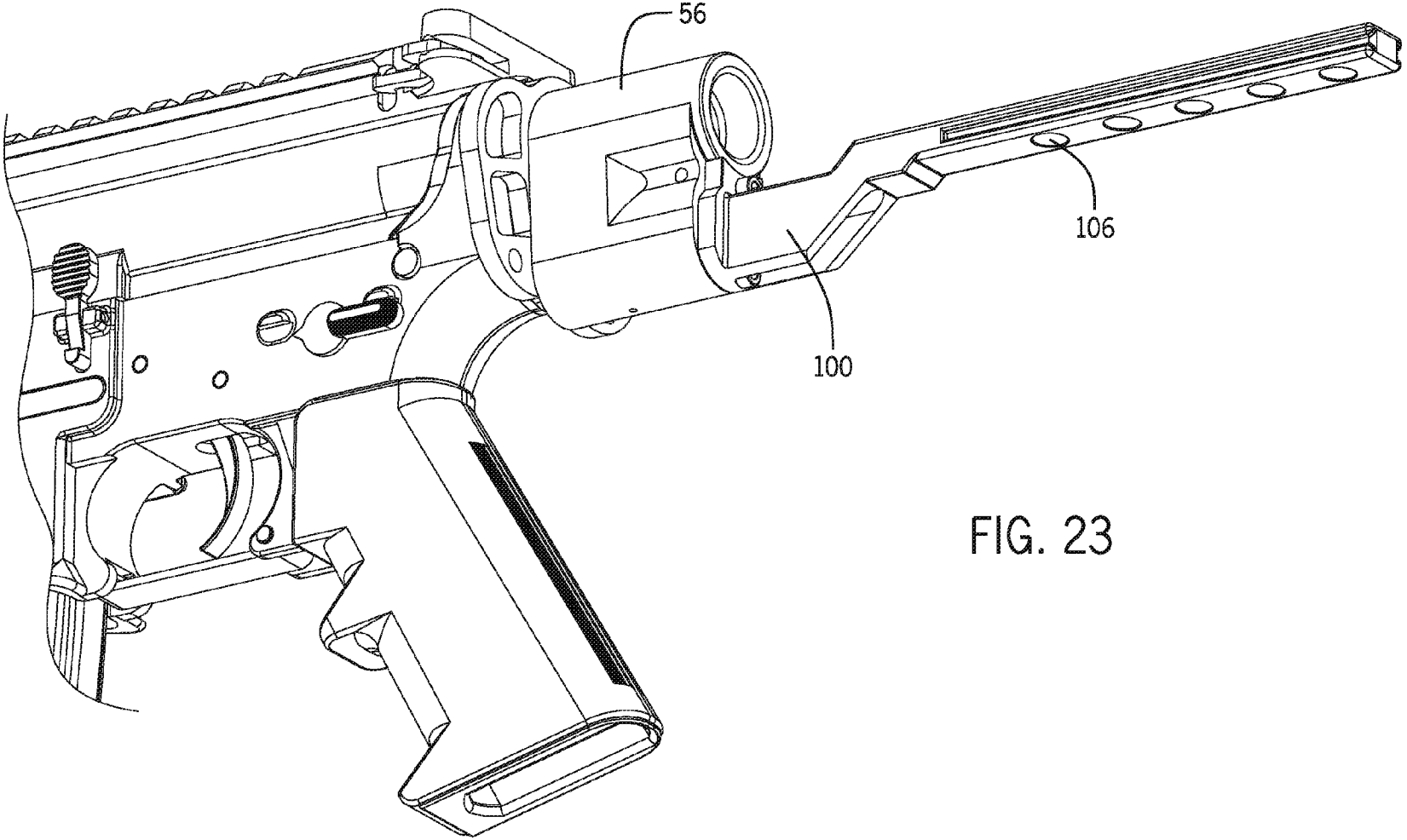
FIG. 23 is a bottom perspective view showing the configuration of the mounting rail.

A stock 102 is mounted to the support rail 100 such that the stock 102 is movable along the length of the support rail 100. The stock 102 includes a latching mechanism 104 that locks the stock into a desired location along the length of the support rail 100. As illustrated in FIG. 23, the support rail 100 includes a series of locking holes 106 that receive a corresponding pin 108 shown in FIG. 21. The pin 108 is retracted by operation of the trigger 109 that moves the pin away from the support rail 100 against a bias spring (not shown). The interaction between the pin 108 and the locking holes 106 hold the stock 102 in a desired location along the length of the bottle 70.

Figure 22:
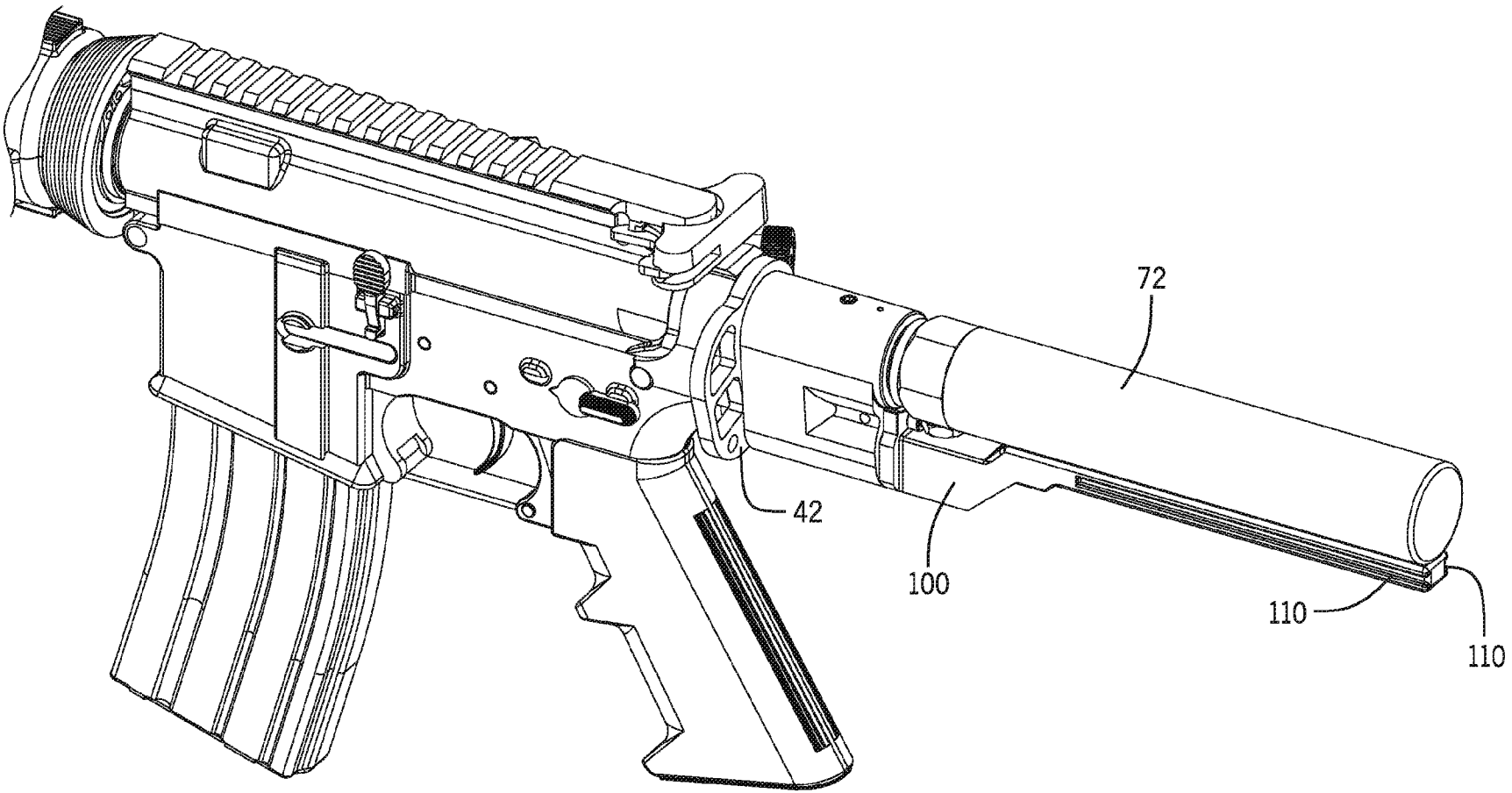
FIG. 22 is a magnified perspective view showing the mounting rail used to support the adjustable stock.
Figure 24:
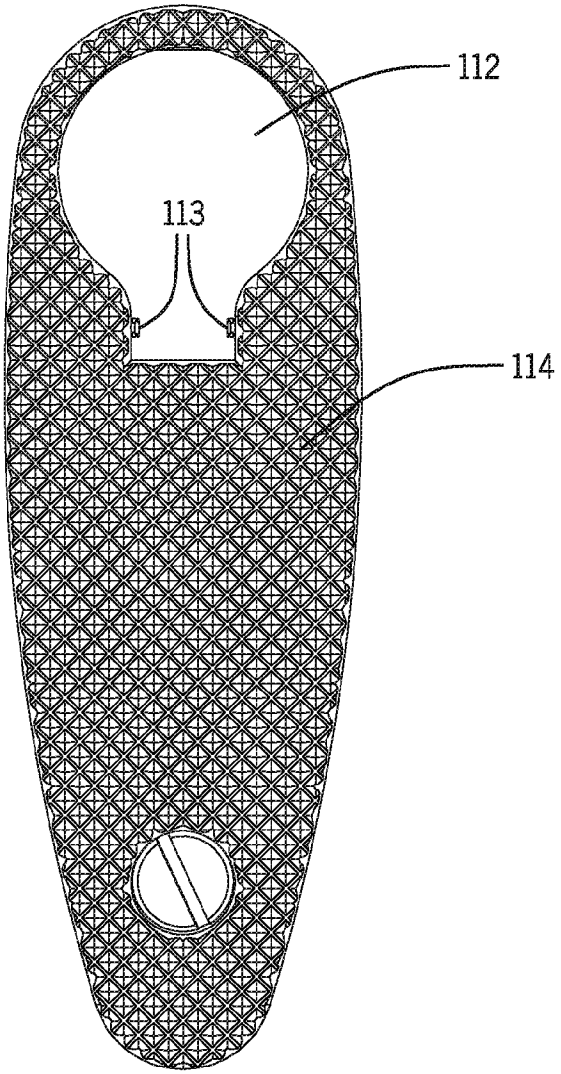
FIG. 24 is an end view of the adjustable stock showing the mounting tabs.

Referring back to FIG. 23, the support rail 100 is mounted to a back surface of the pressure regulator 56 and is located below the bottle 72 to support some of the weight of the bottle, as shown in FIG. 22. The support rail 100 includes a pair of guide slots 110. As shown in FIG. 24, the inner receiving tube 112 includes a pair of tabs 113 that are sized to be received in the pair of guide slots 110 In this manner, the support rail 100 guides the movement of the stock along the bottle 72 without the bottle 72 having to physically support the entire weight of the stock 102. The stock 102 includes a shoulder pad 114.

As can be understood in the embodiment of FIGS. 20-23, the stock 102 is supported by the support rail 100 and moves along the length of the bottle 72. The stock includes an internal tube 112 that surrounds the outer surface of the bottle 72 during movement of the stock along the length of the bottle 72.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A gas supply system for use with an airsoft gun that includes a receiver that includes a drive engine that launches solid plastic projectiles through a barrel, comprising:

a self-contained bottle of pressurized gas having an outlet that provides gas at a first pressure;

a pressure regulator mounted to and supported by the back end of the receiver, wherein the bottle is directly received by the pressure regulator such that the bottle is at least partially supported by the pressure regulator, wherein the pressure regulator is positioned between the back end of the receiver and the bottle, wherein the pressure regulator receives the supply of gas at the first pressure and discharges the supply of gas at a second pressure lower than the first pressure;

an adjustment dial formed on the pressure regulator, wherein the adjustment dial is movable to adjust the second pressure; and a stock mounted to the bottle of pressurized gas.

2. The gas supply system of claim 1 wherein the stock is movable along the length of the bottle of pressurized gas.

3. The gas supply system of claim 1 wherein the stock is secured to the bottle of pressurized gas.

4. The gas supply system of claim 1 wherein the stock is attached to the bottle of pressurized gas by a friction fit.

5. The gas supply system of claim 4 wherein the stock is attached to only a back end of the bottle of pressurized gas.

6. The gas supply system of claim 4 wherein the stock surrounds the bottle of pressurized gas and is moveable along the length of the bottle of pressurized gas.

7. A gas supply system for use with an airsoft gun that includes a receiver that includes a drive engine that launches solid plastic projectiles through a barrel, comprising:

a self-contained bottle of pressurized gas having an outlet that provides gas at a first pressure;

a pressure regulator supported by the back end of the receiver and positioned between the back end of the receiver and the bottle, wherein the pressure regulator receives the supply of gas at the first pressure and discharges the supply of gas at a second pressure lower than the first pressure;

an adjustment dial formed on the pressure regulator, wherein the adjustment dial is movable to adjust the second pressure;

a stock mounted to the bottle of pressurized gas; and a support rail attached to the pressure regulator and configured to receive and support the stock.

8. The gas supply system of claim 7 wherein the stock surrounds the bottle of pressurized gas and moves along the support rail.

9. The gas supply system of claim 1 wherein an upper portion of the regulator receives the bottle of pressurized gas and a lower portion of the regulator includes the adjustment dial.

10. An airsoft gun, comprising:

a receiver having a trigger and operable to launch solid plastic projectiles;

a barrel connected to the receiver to receive the solid plastic projectiles;

a bottle of pressurized gas having an outlet that supplies gas at a first pressure;

a pressure regulator mounted to and supported by the back end of the receiver, wherein the bottle is directly received by the pressure regulator such that the bottle is at least partially supported by the pressure regulator, wherein the pressure regulator is positioned between the back end of the receiver and the bottle of pressurized gas, wherein the pressure regulator receives the supply of gas at the first pressure and discharges the supply of gas at a second pressure lower than the first pressure;

a stock mounted to the bottle of pressurized gas; and an adjustment dial formed on the pressure regulator, wherein the adjustment dial is movable to adjust the second pressure.

11. The airsoft gun of claim 10 wherein the stock is movable along the length of the bottle of pressurized gas.

12. The airsoft gun of claim 10 wherein the stock is secured to the bottle of pressurized gas.

13. The airsoft gun of claim 10 wherein the stock is attached to the bottle of pressurized gas by a friction fit.

14. The airsoft gun of claim 13 wherein the stock is attached to only a back end of the bottle of pressurized gas.

15. The airsoft gun of claim 13 wherein the stock surrounds the bottle of pressurized gas and is moveable along the length of the bottle of pressurized gas.

16. An airsoft gun, comprising:

a receiver having a trigger and operable to launch solid plastic projectiles;

a barrel connected to the receiver to receive the solid plastic projectiles;

a bottle of pressurized gas having an outlet that supplies gas at a first pressure;

a pressure regulator supported by the back end of the receiver and positioned between the back end of the receiver and the bottle of pressurized gas, wherein the pressure regulator receives the supply of gas at the first pressure and discharges the supply of gas at a second pressure lower than the first pressure;

a stock mounted to the bottle of pressurized gas;

an adjustment dial formed on the pressure regulator, wherein the adjustment dial is movable to adjust the second pressure; and a support rail attached to the pressure regulator and configured to receive and support the stock.

17. The airsoft gun of claim 16 wherein the stock surrounds the bottle of pressurized gas and moves along the support rail.

18. The airsoft gun of claim 10 wherein an upper portion of the regulator receives the bottle of pressurized gas and a lower portion of the regulator includes the adjustment dial.

* * * * *